US009303410B2

(12) United States Patent
Steffes et al.

(10) Patent No.: US 9,303,410 B2
(45) Date of Patent: Apr. 5, 2016

(54) SINGLE PANEL SIDING PRODUCT

(71) Applicant: CertainTeed Corporation, Valley Forge, PA (US)

(72) Inventors: Stephen W. Steffes, McPherson, KS (US); Brian W. Kirn, Hatboro, PA (US); David J. Stucky, Grass Lake, MI (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/574,521

(22) Filed: Dec. 18, 2014

(65) Prior Publication Data

US 2015/0167313 A1 Jun. 18, 2015

Related U.S. Application Data

(60) Provisional application No. 61/917,553, filed on Dec. 18, 2001.

(51) Int. Cl.

| | |
|---|---|
| ***E04D 1/00*** | (2006.01) |
| ***E04F 13/18*** | (2006.01) |
| ***E04F 13/08*** | (2006.01) |

(52) U.S. Cl.

CPC ..... *E04F 13/18* (2013.01); *E04F 13/0864* (2013.01)

(58) Field of Classification Search

CPC . E04D 1/20; B29L 2031/104; E04F 13/0864; E04F 13/072; E04F 13/18

USPC ..... 52/518, 531, 533

See application file for complete search history.

(56) References Cited

U.S. PATENT DOCUMENTS

| | | | | | |
|---|---|---|---|---|---|
| 1,315,260 | A | | 9/1919 | Tischler | |
| 1,366,175 | A | | 1/1921 | Hansen | |
| 1,404,483 | A | * | 1/1922 | Scharwath et al. | 52/560 |
| 2,168,218 | A | * | 8/1939 | Kirschbraun | 52/560 |
| 2,735,143 | A | * | 2/1956 | Kearns | 52/521 |
| 3,579,940 | A | * | 5/1971 | Greenleaf | 52/542 |
| 3,720,031 | A | * | 3/1973 | Wilson et al. | 52/520 |
| 3,852,934 | A | * | 12/1974 | Kirkhuff | 52/539 |
| 3,943,677 | A | * | 3/1976 | Carothers | 52/309.4 |
| 4,128,369 | A | * | 12/1978 | Kemerer et al. | 425/113 |

(Continued)

OTHER PUBLICATIONS

Technical Search, 1 pg, 2014.

(Continued)

*Primary Examiner* — Basil Katcheves
*Assistant Examiner* — Joshua Ihezie
(74) *Attorney, Agent, or Firm* — Abel Law Group, LLP; Alexander H. Plache

(57) ABSTRACT

A siding product may include a panel having a substantially rectangular structure with a simulated pattern on a front face thereof. The panel may be formed from a polymer and may include color variegation. The panel may have a hollow back and be a single shake configuration that does not simulate more than one shake or more than one course of siding. The siding product may include a panel having a front face with a simulated pattern. The panel can include a hollow back, a longitudinal length extending in an x-direction, a lateral width extending in a y-direction, and a transverse depth extending in a z-direction. The panel can have a plurality of reinforcement ribs on the hollow back that extend longitudinally in the x-direction and transversely in the z-direction. In a version, none of the reinforcement ribs extend laterally in the y-direction.

6 Claims, 8 Drawing Sheets

(56) References Cited

U.S. PATENT DOCUMENTS

| | | | | | |
|---|---|---|---|---|---|
| 4,835,925 | A | | 6/1989 | Hoffmann, Sr. | |
| 4,972,647 | A | * | 11/1990 | Meldrum | 52/52 |
| 5,295,340 | A | * | 3/1994 | Collins | 52/518 |
| 5,517,794 | A | | 5/1996 | Wagner | |
| 5,615,523 | A | | 4/1997 | Wells et al. | |
| 5,711,126 | A | * | 1/1998 | Wells | 52/519 |
| 5,743,059 | A | * | 4/1998 | Fifield | 52/519 |
| 5,902,683 | A | * | 5/1999 | Sieloff | 428/412 |
| 5,946,877 | A | * | 9/1999 | Gallinat et al. | 52/543 |
| 5,956,914 | A | | 9/1999 | Williamson | |
| 5,974,748 | A | | 11/1999 | Sciuga et al. | |
| 5,992,116 | A | * | 11/1999 | Ternes et al. | 52/518 |
| 6,021,611 | A | * | 2/2000 | Wells et al. | 52/98 |
| 6,112,492 | A | | 9/2000 | Wells et al. | |
| 6,125,602 | A | * | 10/2000 | Freiborg et al. | 52/560 |
| 6,418,692 | B1 | * | 7/2002 | Freshwater et al. | 52/553 |
| 6,530,189 | B2 | * | 3/2003 | Freshwater et al. | 52/553 |
| 6,883,282 | B1 | | 4/2005 | Newhart, III | |
| 8,136,322 | B2 | * | 3/2012 | Shadwell et al. | 52/518 |
| 8,261,505 | B2 | * | 9/2012 | Kalkanoglu et al. | 52/543 |
| 8,371,081 | B2 | | 2/2013 | Bennett et al. | |
| 8,375,663 | B2 | | 2/2013 | Johnston et al. | |
| 8,453,410 | B2 | | 6/2013 | Kalkanoglu et al. | |
| 8,516,765 | B2 | * | 8/2013 | Shaw et al. | 52/553 |
| 8,572,921 | B2 | * | 11/2013 | Ward et al. | 52/519 |
| 8,590,270 | B2 | | 11/2013 | Martinique | |
| 8,677,709 | B2 | * | 3/2014 | DiLonardo et al. | 52/533 |
| 8,850,771 | B2 | | 10/2014 | Jenkins et al. | |
| 2005/0072092 | A1 | * | 4/2005 | Williams | 52/518 |
| 2005/0089672 | A1 | * | 4/2005 | Kuipers et al. | 428/156 |
| 2005/0153103 | A1 | * | 7/2005 | Meyer et al. | 428/156 |
| 2006/0026908 | A1 | * | 2/2006 | Gregori et al. | 52/105 |
| 2006/0130419 | A1 | * | 6/2006 | Bowman | 52/560 |
| 2008/0236064 | A1 | * | 10/2008 | Sippola | 52/177 |
| 2011/0061323 | A1 | * | 3/2011 | Schwarz et al. | 52/314 |
| 2012/0085053 | A1 | * | 4/2012 | Barone | 52/302.1 |
| 2012/0117906 | A1 | * | 5/2012 | Moller et al. | 52/403.1 |
| 2012/0117908 | A1 | * | 5/2012 | Turek et al. | 52/519 |

OTHER PUBLICATIONS

Clearance search results, 2 pgs, 2013.

* cited by examiner

SINGLE PANEL SIDING PRODUCT

This application claims priority to and the benefit of U.S. Prov. App. No. 61/917,553, filed Dec. 18, 2013, and is incorporated herein by reference in its entirety.

BACKGROUND OF THE INVENTION

1. Field of the Disclosure

The present invention relates in general to building products and, in particular, to a single panel siding product.

2. Description of the Related Art

Natural material such as wood shake is used as a building product to cover a substrate of a building, such as a wall. The wood shake provides the function of covering and protecting the wall of the building. In addition, the wood shake has an aesthetically appealing appearance.

Wood shake is traditionally formed from wood such as cedar. Wood shake is relatively expensive to produce because it requires harvesting and splitting of wood, which is time consuming, labor intensive, and results in excess unused wood that is not suitable for shake.

In addition, wood shake is relatively expensive and labor intensive to install. Several individual pieces of wood shake are first mounted to the substrate in a row. Care is taken to space each of the wood shake from each to accommodate for expansion and retraction of the wood shake due to atmospheric changes. A layer of felt is then mounted to the substrate overlapping a portion of the row of wood shake. Then a second row of wood shake is mounted to the substrate overlapping the felt such that the felt interleaves the two rows of shake. This configuration is repeated such that several rows of wood shake interleaved with felt cover the substrate.

With wood shake, the interleaved felt is intended to prevent wind and blowing precipitation from blowing between adjacent pieces of wood shake and below overlapping pieces of wood shake. As such, the felt reduces water logging of the wood shake and water intrusion to the substrate and acts as an insulator. However, as stated above, the material and installation associated with the interleaved felt is relatively expensive and labor intensive.

In addition, attempts to produce polymeric building products to have an appearance that simulates the look of natural material have had limited success. In particular, improvements in the texture and color of the polymeric building product continue to be of interest. Accordingly, there remains an opportunity to develop a building product that has a color variation that simulates natural material and a method of making the same while eliminating the disadvantages highlighted above.

SUMMARY

Embodiments of a siding product are disclosed. The siding product may include a panel having a substantially rectangular structure with a simulated pattern on a front face thereof. The panel may be formed from a polymer. The panel may have a hollow back and be a single shake configuration that does not simulate more than one shake or more than one course of siding.

In other embodiments, the siding product may include a panel having a front face with a simulated pattern. The panel can include a hollow back, a longitudinal length extending in an x-direction, a lateral width extending in a y-direction, and a transverse depth extending in a z-direction. The panel can have a plurality of reinforcement ribs on the hollow back that extend longitudinally in the x-direction and transversely in the z-direction. In a version, none of the reinforcement ribs extend laterally in the y-direction.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments as understood by those of ordinary skill in the art.

The use of the same reference symbols in different drawings indicates similar or identical items.

DETAILED DESCRIPTION

Figure 1A:
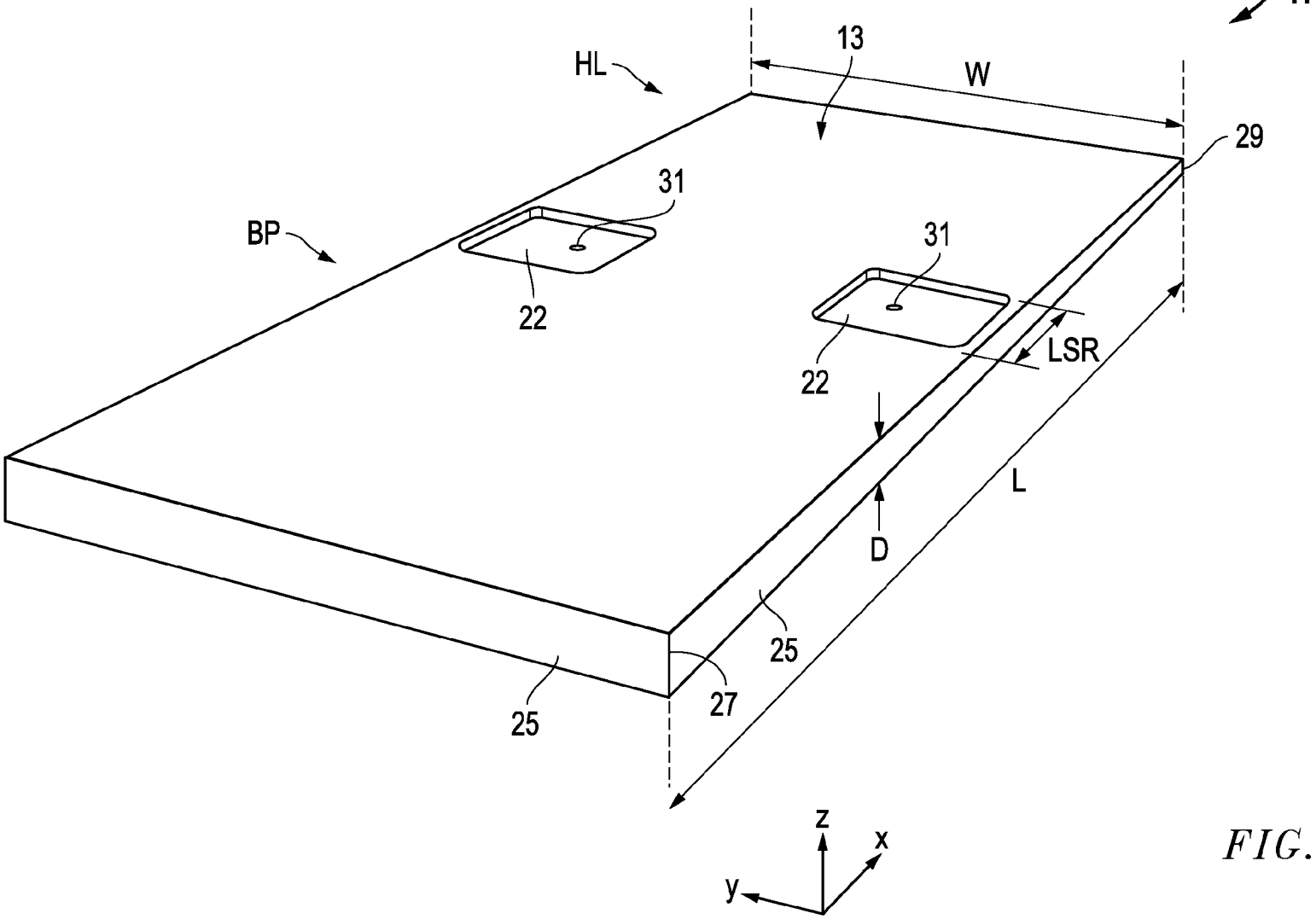
FIGS. 1A and 1B are solid and translucent, respectively, front isometric views of an embodiment of a siding product.

Embodiments of a system, method and apparatus for a single panel siding product are disclosed. For example, as shown in FIG. 1, the siding product may include a panel 11 having a substantially rectangular structure with a simulated pattern on a front face 13 thereof. In a version, the simulated pattern on the front face 13 may comprise a simulated wood grain or simulated slate look. In some embodiments, a same design, pattern or texture can cover the front face 13 including headlap HL and butt portions BP of the front face 13.

The panel 11 may be formed from a variety of materials, such as polymers. The polymers may be molded and rigid. The panel 11 may include color variegation, as well as two-dimensional or three-dimensional patterns. In a particular embodiment, the panel may comprise polypropylene. In an embodiment, the siding product may include, comprise or consist of a single shake configuration that does not simulate more than one shake or more than one course of siding.

For ease of reference, a Cartesian coordinate system is provided the drawings. The panel 11 has a longitudinal length L extending in an x-direction, a lateral width W extending in a y-direction, a transverse depth D extending in a z-direction. The panel 11 can have an aspect ratio defined as (panel length L):(panel width W). The aspect ratio of the panel 11 can be at least about 1.5:1, such as at least about 1.75:1, or even at least about 2:1. In other versions, the aspect ratio can be not greater than about 3:1, such as not greater than about 2.75:1, or even not greater than about 2.5:1. The aspect ratio can be in a range between any of these values.

Figure 2:
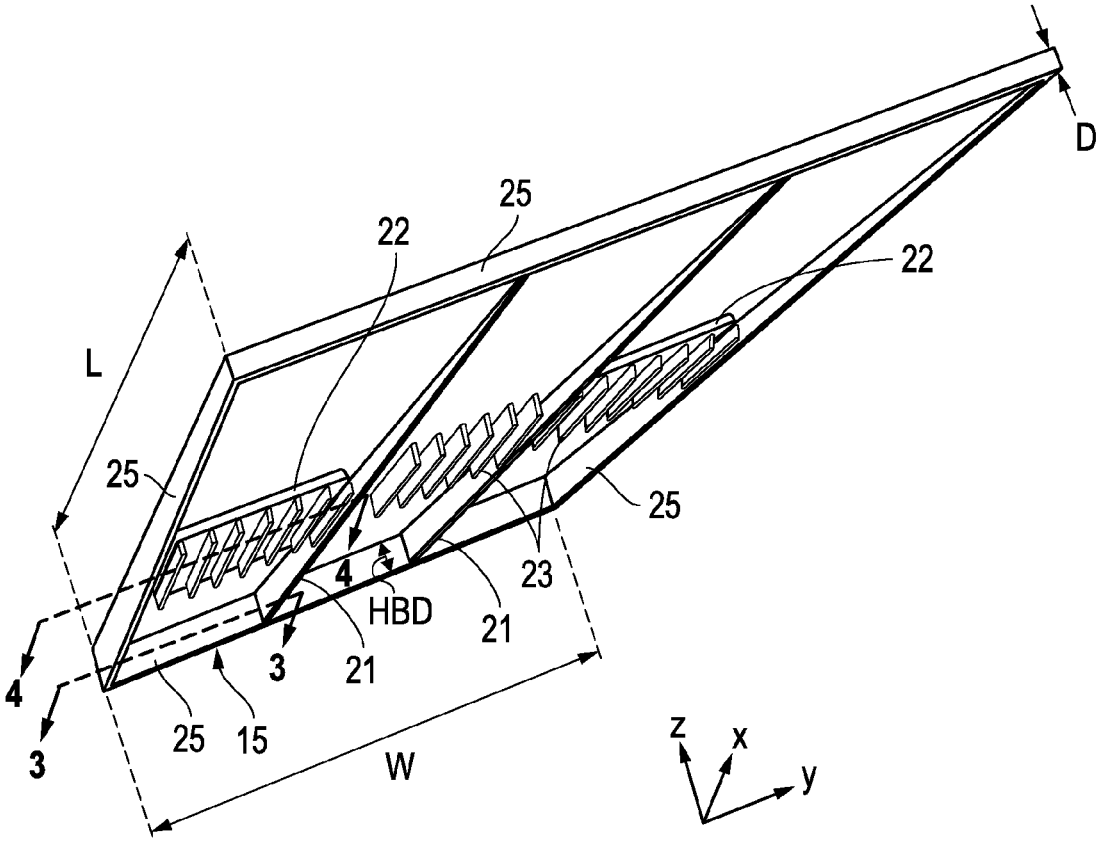
FIG. 2 is a rear isometric view of an embodiment of a siding product.

As shown in FIG. 2, embodiments of the panel 11 may include a hollow back 15 that is opposite the front face 13. The panel 11 can have a plurality of reinforcement ribs 21, 23 on the hollow back 15. The ribs 21, 23 can extend longitudinally in the x-direction and transversely in the z-direction. In some embodiments, none of the reinforcement ribs 21, 23 extend laterally in the y-direction.

In some versions, the panel 11 may include a side wall 25 extending continuously around a perimeter thereof. The side wall 25 around the panel 11 can define a hollow back depth HBD. See FIGS. 2 and 3. In some versions, the panel 11 can have a hollow back depth HBD of at least about 0.25 inches, such as at least about 0.375 inches, or even at least about 0.50 inches. In other versions, the HBD can be not greater than about 1 inch, such as not greater than about 0.75 inches. The HBD can be in a range between any of these values.

In one embodiment, the transverse depth D and hollow back depth HBD of the panel 11 can be tapered. For example, the D and HBD can decrease from a lower longitudinal end 27 (FIG. 1) to an upper longitudinal end 29. Thus, the dimension of the depth D and hollow back depth HBD can vary in one or more dimensions, such as along the x-axis.

Embodiments of the side wall 25 can have a nominal side wall thickness TSW that is substantially similar to a nominal front wall thickness TFW of the panel 11. Versions of the panel 11 may include a nominal front wall thickness TFW of not greater than about 0.110 inches, such as not greater than about 0.100 inches, or even not greater than about 0.090 inches. In other versions, the TFW can be at least about 0.070 inches, such as at least about 0.080 inches. The TFW can be in a range between any of these values.

Some embodiments of the panel 11 may include features that extend beyond the side wall 25. Such features may comprise at least one interlocking tab, alignment feature, extension, etc. In other embodiments, the panel 11 has no extremities extending beyond the perimeter or side wall 25.

Figure 3:
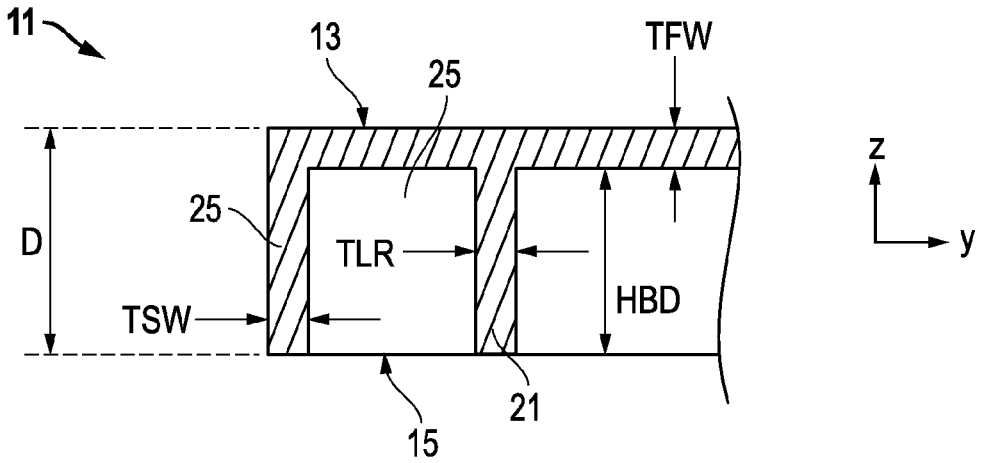
FIG. 3 is a schematic sectional side view of an embodiment of a siding product taken along the line 3-3 of FIG. 2.

Embodiments of the siding product may include the hollow back 15 having a plurality of long ribs 21. The long ribs 21 can extend in the longitudinal direction. In one version, each long rib 21 can have a lateral or long rib thickness TLR (FIG. 3). The long rib thickness TLR can be substantially similar to a nominal front wall thickness of the panel 11. In other version, the long rib thickness TLR can be less than the nominal front wall thickness TFW. In another example, the long rib thickness TLR can be at least about 33% less than the nominal front wall thickness TFW.

Figure 4:
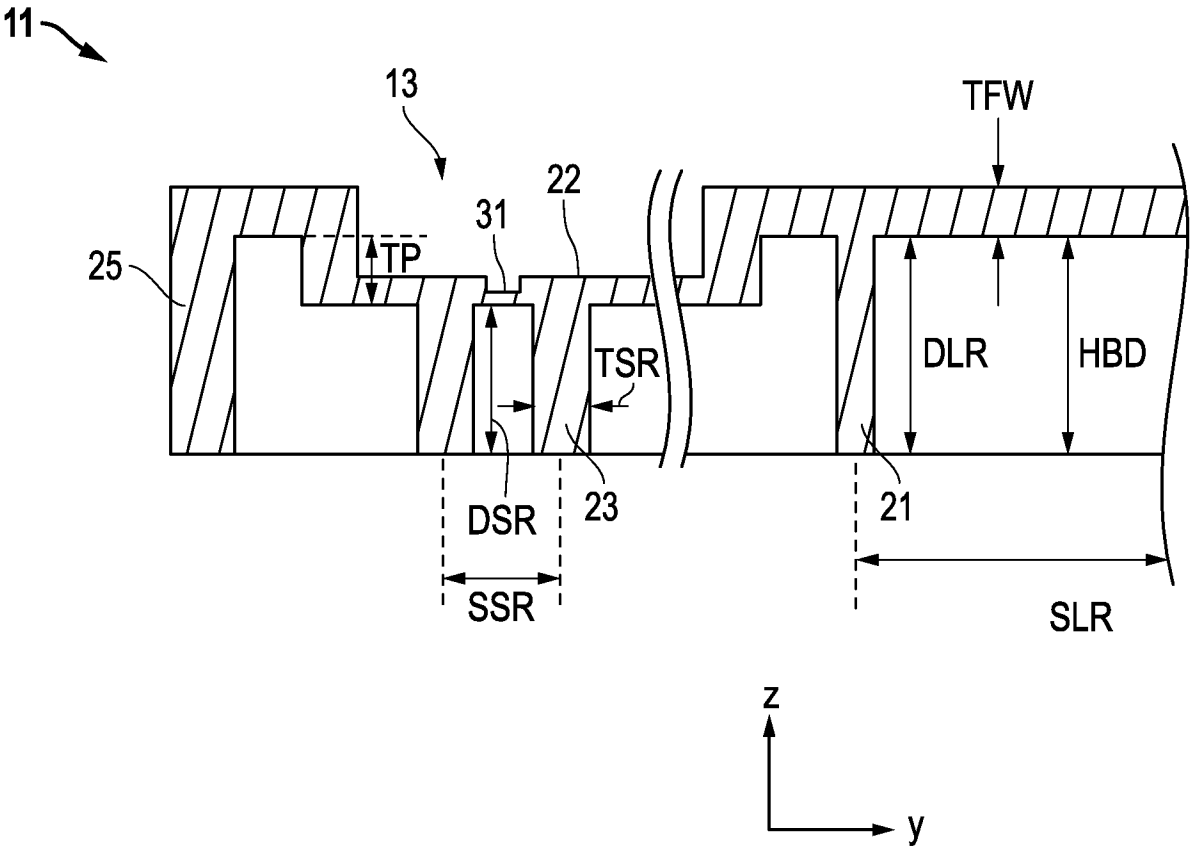
FIG. 4 is a schematic sectional side view of an embodiment of a siding product taken along the line 4-4 of FIG. 2.

In other embodiments, each long rib 21 can have has a depth DLR (FIG. 4). The long rib depth DLR can be the same or less than the hollow back depth HBD. In a version, each long rib 21 can be tapered in at least one direction, such as the longitudinal direction. The long ribs 21 can be substantially parallel to each other. Lengths of the long ribs can extend only in a longitudinal direction. Each of the long ribs 21 can be located in the hollow back 15. Versions of the long ribs 21 can extend from a top perimeter or side wall 25 of panel 11 (e.g., upper longitudinal end 29) to a bottom perimeter thereof (e.g., lower longitudinal end 27). In a particular embodiment, the panel 11 can comprise only 2 long ribs, such as only 3 long ribs, or even only 4 long ribs.

Embodiments of the siding product can include a hollow back 15 that comprises a plurality of short ribs 23. The short ribs 23 can extend in the longitudinal direction. Each short rib 23 can have a longitudinal length LSR (FIG. 1) that is less than a longitudinal length of the hollow back 15. For example, the short rib longitudinal length LSR can be not greater than about 6 inches, such as not greater than about 5 inches, not greater than about 4 inches, or even not greater than about 3 inches. In other versions, the LSR can be at least about 1 inch, such as at least about 2 inches, or even at least about 3 inches. The LSR can be in a range between any of these values.

The siding product also may include embodiments where each short rib 23 has a lateral thickness TSR (FIG. 4). The TSR can be substantially similar to the nominal front wall thickness TFW of the panel 11. The short rib lateral thickness TSR can be less than the nominal front wall thickness TFW. The TSR can be at least about 33% less than the TFW. Embodiments of the short ribs 23 can be substantially parallel to each other. Other embodiments of the short ribs 23 can extend only in a longitudinal direction.

In another example, at least some of the short ribs 23 do not extend directly from the hollow back 15 and are located on pads 22 (FIGS. 2 and 4) on the hollow back 15. Note that pads 22 appear as protruding pads on the back side of the panel, but appear as recesses on the front side of the panel. As shown in FIG. 2, at least some of the short ribs 23 can extend directly from the hollow back 15 and are not located on pads 22. Embodiments of the short ribs 23 can be tapered in at least one direction, such as the longitudinal direction.

Embodiments of the panel 11 may include a plurality of fastener locations 31 (FIG. 1) in the recesses 22 on the front face 13 thereof. In some examples, the hollow back 15 may include a pad 22 opposite each fastener location 31. See, e.g., FIG. 1B. In one version, each pad 22 can be located adjacent a lateral side edge 25 of the panel 11. Each pad 22 can have a recess depth or pad thickness TP (FIG. 4) in a transverse or depth direction. For example, the pad thickness TP can be the same or less than the hollow back depth HBD.

In some versions, each pad 22 may include a plurality of short ribs 23. Each short rib 23 can have a depth DSR (FIG. 4) that extends in a same direction as the pad thickness TP. A combination of the short rib depth DSR and the pad thickness TP can be equal to or not greater than the hollow back depth HBD.

As shown in FIG. 2, the hollow back 15 can include both long ribs 21 and a set of short ribs 23 between adjacent ones of the long ribs 21. The long ribs 21 can be spaced apart from each other by a long rib spacing SLR. For example, the SLR can be at least about 2 inches. Embodiments of the short ribs 23 can be spaced apart from each by a short rib spacing SSR. For example, the SSR can be not greater than about 0.25 inches.

Figure 1B:
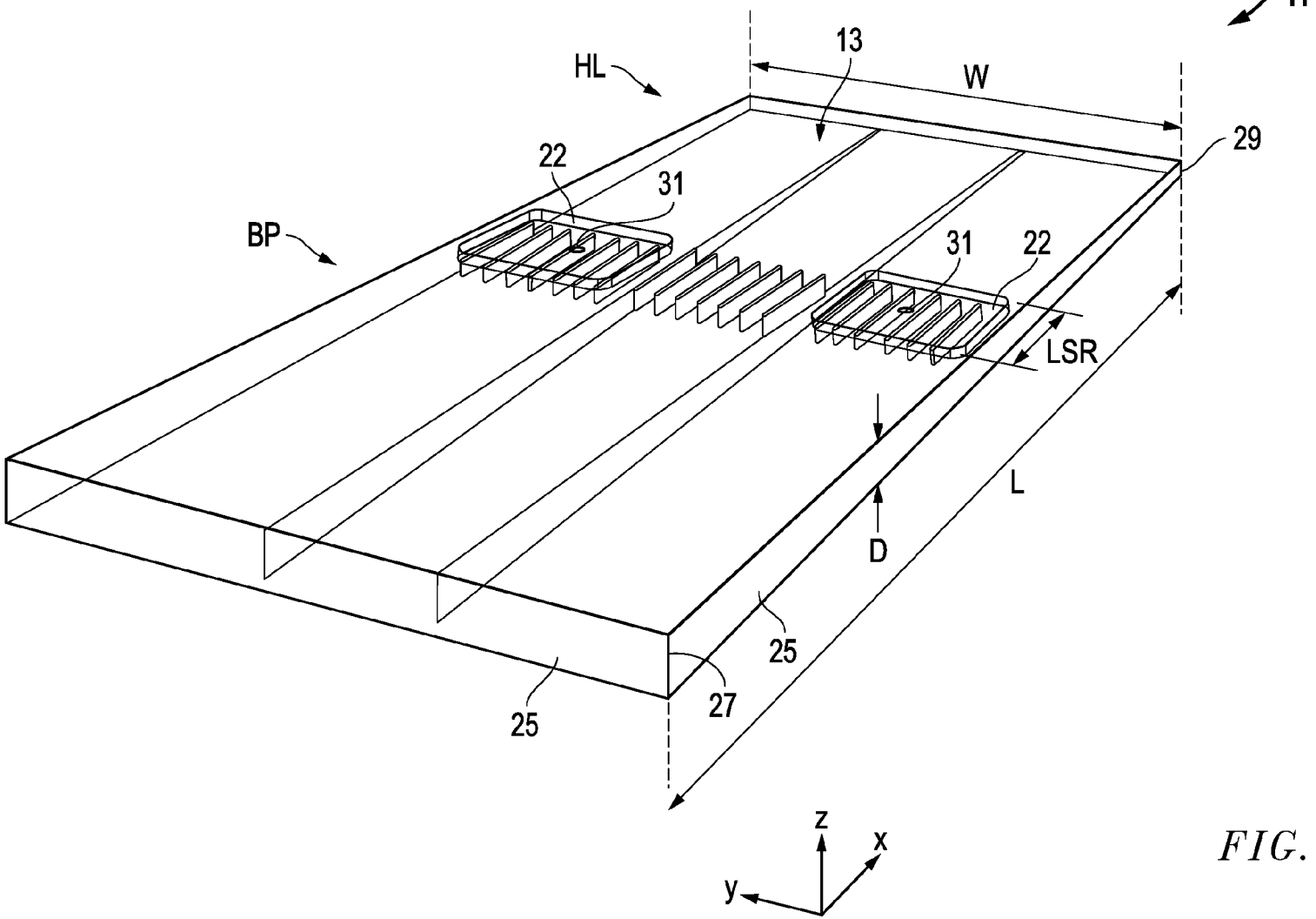

As shown in the translucent view of FIG. 1B, the panel 11 can have a set of short ribs 23 that are located at a midsection of the long ribs 21 and of the panel 11. As shown in that drawing, the set of short ribs 23 can be located laterally between two adjacent pads 22, substantially in a longitudinal and lateral center of the hollow back 15 and panel 11.

Figure 5A:
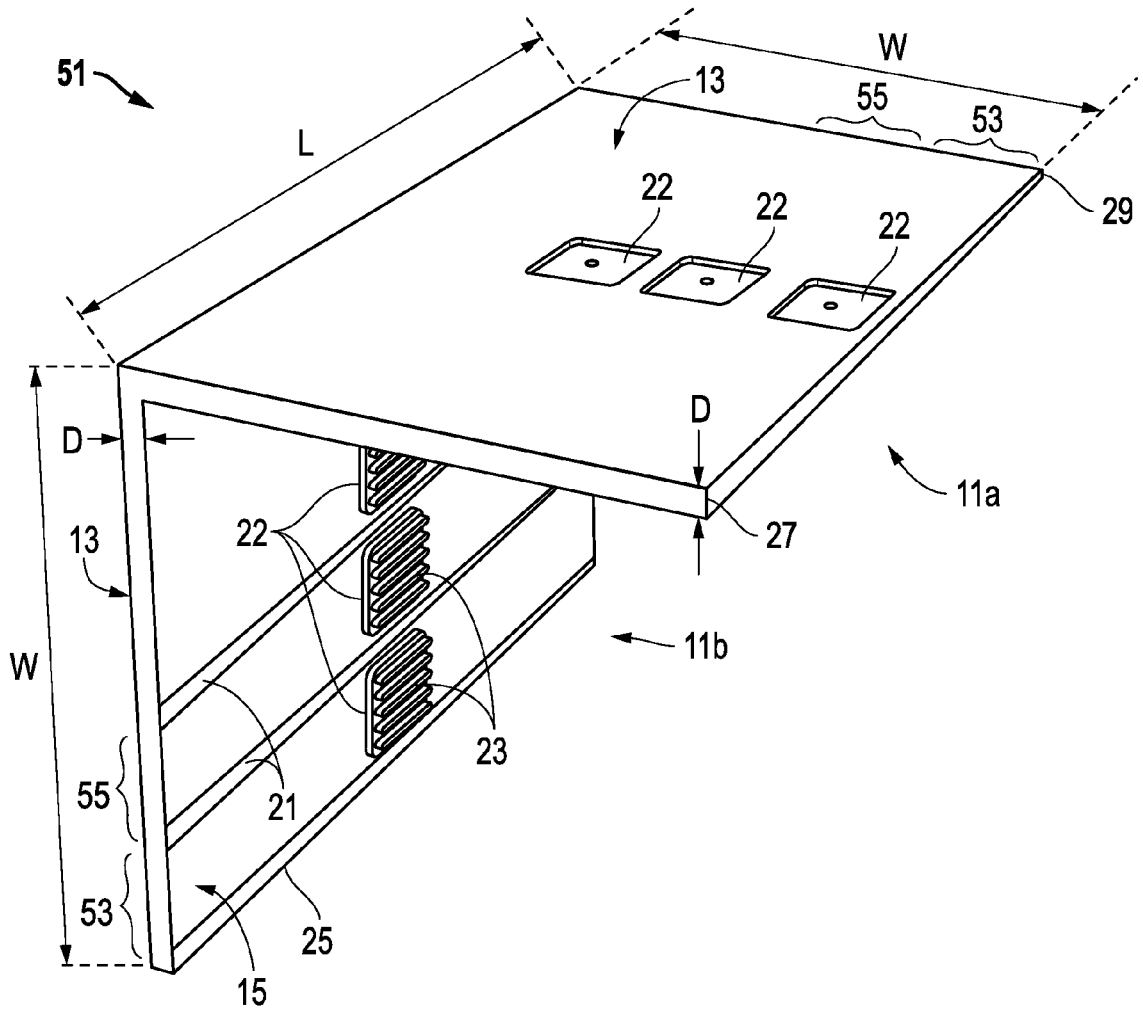
FIGS. 5A and 5B are solid and translucent, respectively, front isometric views of an embodiment of a corner siding product.
Figure 5B:
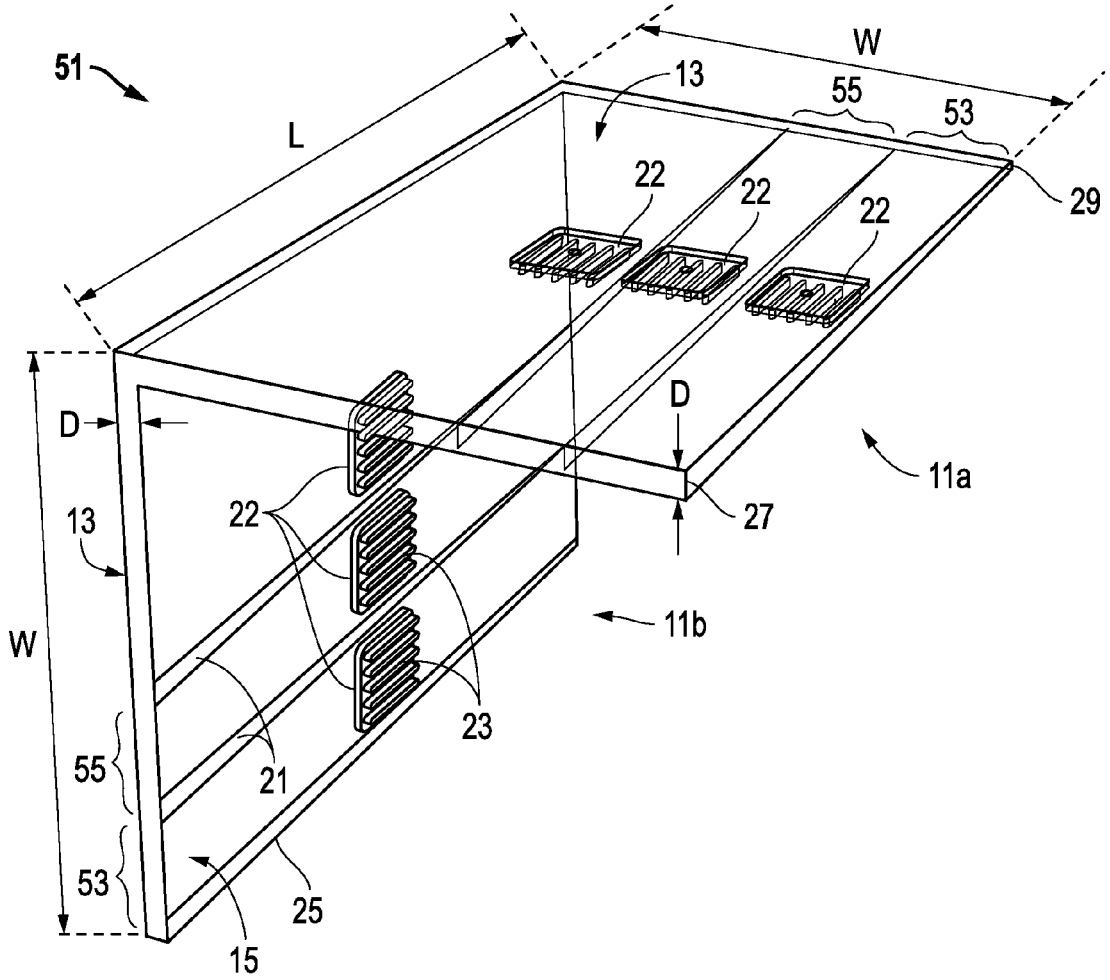
Figure 6:
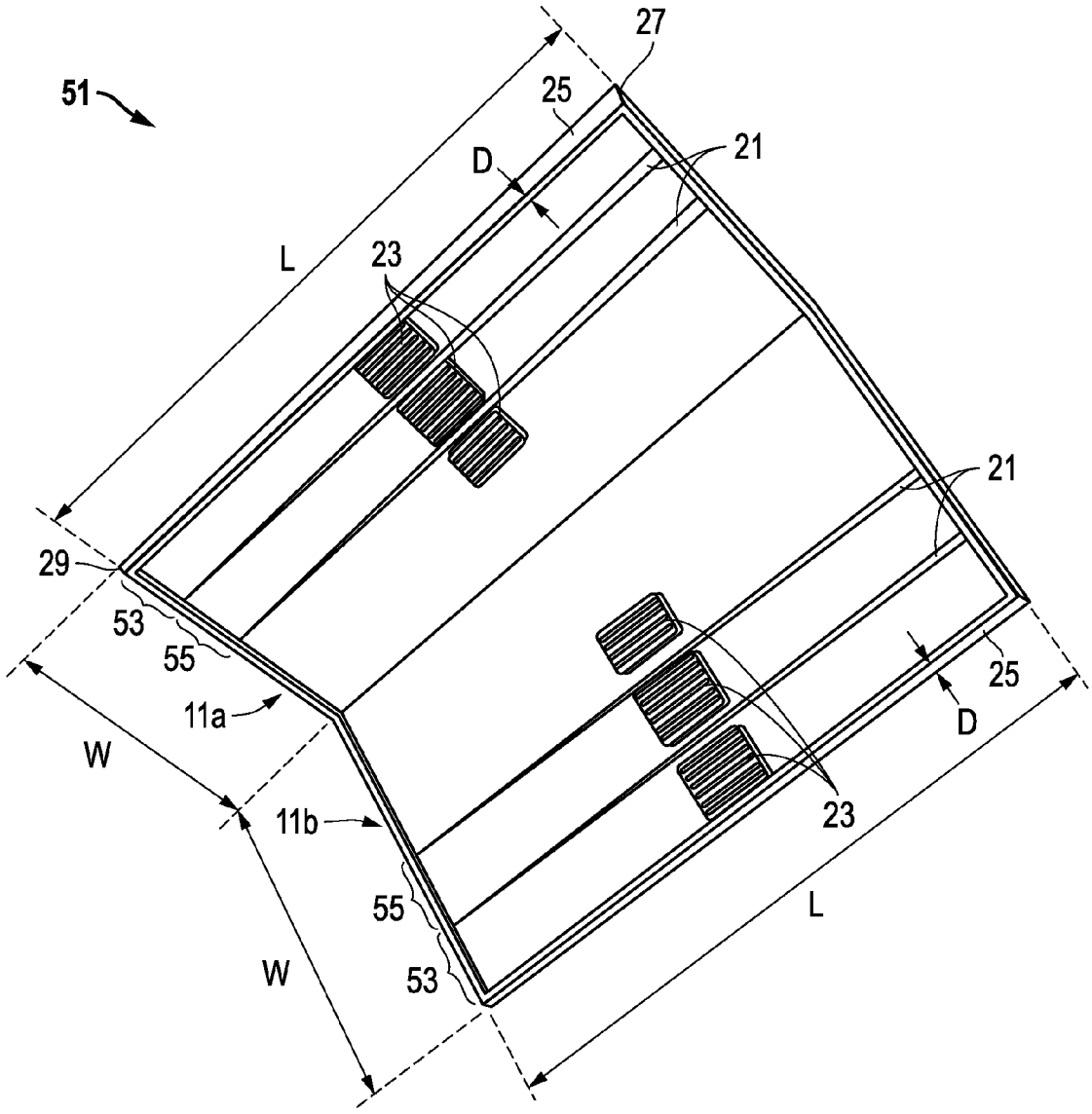
FIG. 6 is a rear isometric view of an embodiment of a corner siding product.

Referring now to FIGS. 5 and 6, an embodiment of the siding product can include a corner panel 51. The corner panel 51 can be essentially formed from two of the panels 11*a* and 11*b*, as described herein. The corner panel 51 can have substantially perpendicular panels 11*a* and 11*b* configured to be complementary in shape to a corner of a building. Embodiments of the corner panel 51 may comprise a compound mitre, such that each panel 11*a*, 11*b* is tapered in at least two directions, as shown. Although the corner panel 51 has two panels 11*a*, 11*b*, it has only one panel (i.e., a single panel) on each side of the building (e.g., the two building sides that intersect at a corner) on which it is mounted.

Figure 7:
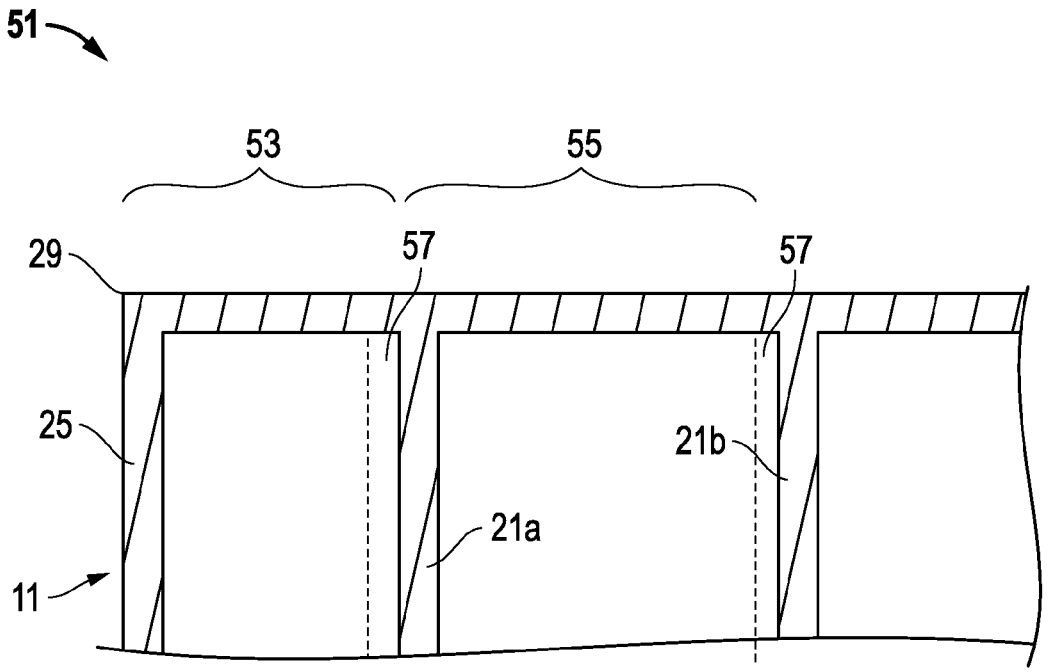
FIGS. 7 and 8 are enlarged upper rear views of a portion of an embodiment of a corner siding product before and after trimming, respectively.
Figure 8:
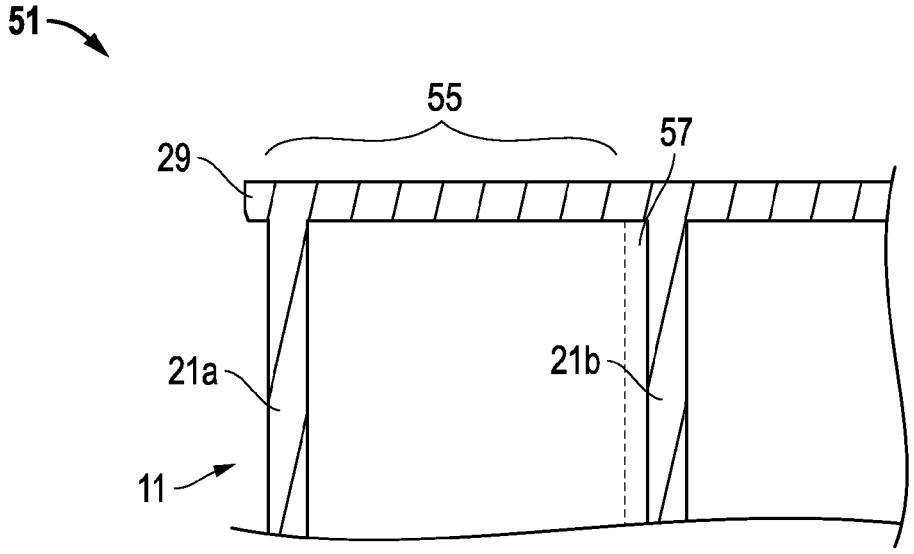

In some versions, each panel 11*a*, 11*b* of the corner panel 51 can be cut or trimmed in segments 53, 55. For example, each segment 53, 55 can include a notch 57 (FIG. 7). The notches 57 extend along the longitudinal length of each segment 53, 55 at an outboard intersection of long ribs 21 when facing a rear (i.e., the hollow back 15) of the segment 53, 55. Each segment 53, 55 may include a long rib 21 that extends longitudinally in the hollow back 15. For example, after trimming segment 53 (e.g., along the vertical dashed line in FIG. 7), the long rib 21*a* becomes the outer perimeter side wall (FIG. 8) of the panel 11. The same procedure may be performed for segment 55, such that long rib 21*b* would become the outer perimeter side wall.

In other embodiments, the siding product may include one or more of the following items:

1. A siding product, comprising:

a panel comprising a polymer and a substantially rectangular structure having a simulated pattern on a front face thereof and a hollow back, and the panel comprises a single shake configuration that does not simulate more than one shake or more than one course of siding.

2. The siding product of item 1, wherein the panel has a side wall extending continuously around a perimeter of the panel to define a hollow back thickness, the side wall having a nominal side wall thickness that is substantially similar to a nominal front wall thickness of the panel.

3. The siding product of item 2, wherein the panel has no extremities extending beyond the side wall or perimeter.

4. The siding product of item 1, wherein the panel has a nominal front wall thickness of not greater than about 0.110 inches, not greater than about 0.100 inches, not greater than about 0.090 inches, and at least about 0.070 inches, at least about 0.080 inches.

5. The siding product of item 1, wherein the panel has a hollow back depth of at least about 0.10 inches, at least about 0.25 inches, at least about 0.375 inches, at least about 0.50 inches, and not greater than about 1 inch, not greater than about 0.75 inches.

6. The siding product of item 1, wherein the panel has a hollow back depth that is tapered from a lower longitudinal end to an upper longitudinal end.

7. The siding product of item 1, wherein the siding product is not a roofing product.

8. The siding product of item 1, wherein a same texture covers the front face including headlap and butt portions of the front face.

9. The siding product of item 1, wherein the panel has an aspect ratio of (panel length L):(panel width W) in a range of about 1.5:1 to about 3:1.

10. The siding product of item 1, wherein the hollow back comprises a plurality of long ribs extending in the longitudinal direction from adjacent a top of the panel to adjacent a bottom of the panel.

11. The siding product of item 10, wherein each long rib has a lateral thickness that is substantially similar to a nominal front wall thickness of the panel, wherein the long rib lateral thickness is less than the nominal front wall thickness, wherein the long rib lateral thickness is at least about 33% less than the nominal front wall thickness.

12. The siding product of item 10, wherein each long rib has a depth that substantially equal to a depth of the hollow back, such that the long ribs and a perimeter edge of the panel are substantially co-planar.

13. The siding product of item 10, wherein each long rib is tapered in at least one direction.

14. The siding product of item 10, wherein the long ribs are substantially parallel to each other and extend only in a longitudinal direction.

15. The siding product of item 10, wherein each of the long ribs are located in the hollow back, and extend from a top perimeter thereof to a bottom perimeter thereof.

16. The siding product of item 10, wherein the panel comprises only 2 long ribs, only 3 long ribs, or only 4 long ribs.

17. The siding product of item 1, wherein the hollow back comprises a plurality of short ribs extending in the longitudinal direction, each short rib having a longitudinal length that is less than a length of the hollow back.

18. The siding product of item 17, wherein the short rib longitudinal length is not greater than about 6 inches, not greater than about 5 inches, not greater than about 4 inches, not greater than about 3 inches, and at least about 1 inch, at least about 2 inches, at least about 3 inches.

19. The siding product of item 17, wherein each short rib has a lateral thickness that is substantially similar to a nominal front wall thickness of the panel, wherein the short rib lateral thickness is less than the nominal front wall thickness, wherein the short rib lateral thickness is at least about 33% less than the nominal front wall thickness.

20. The siding product of item 17, wherein the short ribs are substantially parallel to each other and extend only in a longitudinal direction.

21. The siding product of item 17, wherein at least some of the short ribs do not extend directly from the hollow back and are located on pads on the hollow back 22. The siding product of item 17, wherein each short rib has a depth that substantially equal to a depth of the hollow back, such that the short ribs and a perimeter edge of the panel are substantially co-planar.

23. The siding product of item 17, wherein said at least some of the short ribs are located laterally between two adjacent pads, substantially in a longitudinal and lateral center of the hollow back of the panel.

24. The siding product of item 17, wherein at least some of the short ribs extend directly from the hollow back and are not located on pads.

25. The siding product of item 17, wherein the short ribs are tapered in at least one direction.

26. The siding product of item 17, wherein the panel comprises a plurality of recesses and fastener locations on the front face thereof, and the hollow back comprises a pad opposite each recess and fastener location, each recess and pad having a thickness in a depth direction.

27. The siding product of item 26, wherein each recess and pad is located adjacent a lateral side edge of the panel, or within about 1 inch of the lateral side edge of the panel 28. The siding product of item 26, wherein the recess depth and pad thickness is less than a depth of the hollow back.

29. The siding product of item 26, wherein each pad further comprises a plurality of short ribs extending therefrom.

30. The siding product of item 29, wherein each short rib has a depth extending in a same direction as the pad thickness, and a combination of the short rib depth and the pad thickness is approximately equal to a depth of the hollow back, such that the short ribs are substantially co-planar with a perimeter edge of the panel.

31. The siding product of item 1, wherein the hollow back comprises long ribs and a set of short ribs between adjacent ones of the long ribs.

32. The siding product of item 31, wherein the long ribs are spaced apart from each other by a long rib spacing of at least about 2 inches, and the short ribs are spaced apart from each by a short rib spacing of not greater than about 0.25 inches.

33. The siding product of item 31, wherein the set of short ribs is located at a midsection of the long ribs and of the panel.

34. The siding product of item 1, wherein the panel has color variegation.

35. A siding product, comprising:

a panel comprising a front face with a simulated pattern, a hollow back, a longitudinal length extending in an x-direction, a lateral width extending in a y-direction, a transverse depth extending in a z-direction, the panel having a plurality of reinforcement ribs on the hollow back that extend longitudinally in the x-direction and transversely in the z-direction, and none of the reinforcement ribs extend laterally in the y-direction.

36. The siding product of item 35 wherein the panel comprises a corner panel having substantially perpendicular panels configured to be complementary in shape to a corner of a building.

37. The siding product of item 36, wherein each panel of the corner panel is trimmable in segments and configured to produce desired lateral offset effects between vertically adjacent ones of the corner panels.

38. The siding product of item 37, wherein each segment comprises a notch extending along an outboard side of each segment when facing a rear of the segment.

39. The siding product of item 37, wherein each segment comprises a long rib that extends longitudinally in the hollow back and, after trimming a segment, the long rib is an outer perimeter side wall of the panel.

40. The siding product of item 36, wherein the corner panel comprises a compound mitre, such that each panel is tapered in at least two directions.

Embodiments of the siding product are suitable for weather-protective exterior application in overlapping horizontal courses. The sides and edges of the panels are formed and configured to overlap with each other, in same and adjacent courses.

Some embodiments of the siding product are not roofing products. For example, the siding product may not be provided with the requisite thickness, strength, impact resistance, roofing code compliance, fire code compliance, etc., to be used as a roofing product. Versions of the siding product are not 'walkable', as is understood in the roofing industry.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A siding product, comprising:

a panel comprising a polymer and a substantially rectangular structure having a simulated pattern on a front face thereof and a hollow back, and the panel comprises a single shake configuration that does not simulate more than one shake or more than one course of siding;

the panel comprises a plurality of recesses and fastener locations on the front face thereof, and the hollow back comprises a pad opposite each recess and fastener location, each recess and pad having a thickness in a depth direction;

the hollow back comprises a plurality of short ribs extending in the longitudinal direction, each short rib having a longitudinal length that is less than a length of the hollow back, and the short rib longitudinal length is not greater than 6 inches, and at least 1 inch;

each pad comprises at least some of the short ribs extending therefrom; and each short rib has a depth extending in a same direction as the pad thickness, and a combination of the short rib depth and the pad thickness is approximately equal to a depth of the hollow back, such that the short ribs are substantially co-planar with a perimeter edge of the panel.

2. The siding product of claim 1, wherein each short rib has a lateral thickness that is substantially similar to a nominal front wall thickness of the panel, wherein the short rib lateral thickness is less than the nominal front wall thickness, wherein the short rib lateral thickness is at least 33% less than the nominal front wall thickness.

3. The siding product of claim 1, wherein the short ribs are substantially parallel to each other and extend only in a longitudinal direction, and at least some of the short ribs do not extend directly from the hollow back and are located on pads on the hollow back.

4. The siding product of claim 1, wherein:

each short rib has a depth that is substantially equal to a depth of the hollow back, such that the short ribs and a perimeter edge of the panel are substantially co-planar; and said at least some of the short ribs are located laterally between two adjacent pads, substantially in a longitudinal and lateral center of the hollow back of the panel.

5. The siding product of claim 1, wherein at least some of the short ribs extend directly from the hollow back and are not located on pads, and the short ribs are tapered in at least one direction.

6. The siding product of claim 1, wherein:

each recess and pad is located adjacent a lateral side edge of the panel, or within 1 inch of the lateral side edge of the panel; and the recess depth and pad thickness is less than a depth of the hollow back.

* * * * *